US006483233B1

(12) United States Patent
Yasuda

(10) Patent No.: US 6,483,233 B1
(45) Date of Patent: Nov. 19, 2002

(54) COLOR CATHODE-RAY TUBE WITH EXPANDED EFFECTIVE DISPLAY AREA

(75) Inventor: Tsukasa Yasuda, Shiga (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/438,845

(22) Filed: Nov. 12, 1999

(30) Foreign Application Priority Data

Nov. 11, 1998 (JP) ..... 10-320576

(51) Int. Cl.[7] ..... H01J 29/07
(52) U.S. Cl. ..... 313/407; 313/406
(58) Field of Search ..... 313/407, 404, 313/406, 402, 405

(56) References Cited

U.S. PATENT DOCUMENTS

| | | | | | |
|---|---|---|---|---|---|
| 3,772,555 | A | * | 11/1973 | McKee et al. | 313/407 |
| 4,565,945 | A | * | 1/1986 | Pawlikowski et al. | 313/404 |
| 4,804,880 | A | * | 2/1989 | Kavanagh | 313/404 |
| 5,072,151 | A | | 12/1991 | Spina | 313/407 |
| 5,247,224 | A | * | 9/1993 | Bae | 313/404 |
| 5,850,121 | A | * | 12/1998 | Matsudate | 313/407 |

FOREIGN PATENT DOCUMENTS

| | | | |
|---|---|---|---|
| JP | 7-220645 | 8/1995 | H01J/29/07 |
| KR | 9-306373 | 11/1997 | H01J/29/07 |

OTHER PUBLICATIONS

Taiwanese Office Action dated Mar. 26, 2001, with partial English translation.
Korean Office Action dated Sep. 27, 2001, with partial English translation.

* cited by examiner

*Primary Examiner*—Michael H. Day
(74) *Attorney, Agent, or Firm*—McGinn & Gibb, PLLC

(57) ABSTRACT

A color CRT is provided, which makes it possible to use a larger-sized shadow mask without increasing the size of a face panel. This CRT is comprised of a vacuum envelope having a face panel, a funnel connected to the panel, and a neck connected to the funnel. The envelope has a central longitudinal axis approximatley pernendicular to the panel. The panel has studpins fixed to the inside of its side walls. A shadow mask assembly is provided in the envelope, which includes a shadow mask and a frame for supporting the mask. The frame has an approximately rectangular front section, an approximately rectangular middle section, and an approximately rectangular rear section. The front section and the rear section extend in approximately parallel to the central longitudinal axis of the envelope. The front section is shifted outwardly with respect to the rear section to approach the side walls of the panel. The periphery of the mask is fixed to the front section. Spring members are fixed to the outside of the rear section. The assembly is fixed to the inside of the panel by engaging the spring members of the frame with the stud pins of the panel so that the mask is opposed to the phosphor screen formed on the inside of the panel.

20 Claims, 3 Drawing Sheets

COLOR CATHODE-RAY TUBE WITH EXPANDED EFFECTIVE DISPLAY AREA

BACKGROUND OF THE INVENTION

1. Field of the Invention

The present invention relates to a color cathode-ray tube (CRT) and more particularly, to a color CRT having an expanded effective display area without increasing the size of the face panel, in which the space existing between the face panel and the shadow mask is effectively utilized by expanding the opening of the mask frame.

2. Description of the Prior Art

FIGS. 1 and 2 schematically show a part of a prior-art color CRT, in which a shadow mask assembly 101 is fixed to the inside of a face panel 105 made of glass. The panel 105 forms the front section of a vacuum envelope. A substantially rectangular phosphor screen 104 is formed on the inner surface of the panel 105.

As shown in FIGS. 1 and 2, the shadow mask assembly 101 includes a frame 103 with a rectangular opening and a rectangular shadow mask 102 fixed to the frame 103 to close the opening. The frame 103 has a main part 103*b* and a flange 103*a* formed at the rear end of the part 103*b*. The main part 103*b* extends in parallel to the central longitudinal axis of the envelope and the flange 103*a* is perpendicular to the axis. Four spring or elastic members 106, each of which is formed by an elongated metal piece bent to have a step-shaped cross-section, are respectively fixed by welding onto the outer surfaces of the main part 103*b* at its four sides.

The shadow mask 102, which is formed by a thin, rectangular metal plate, has a lot of regularly-arranged small apertures 102*a* for color selection. The mask 102 has a skirt section 102*b* formed at the periphery. The skirt section 102*b* is fixed to the front end of the main part 103*b* of the frame 103 by welding so as to fit into the rectangular opening of the frame 103. The section 102*b* is contacted with the inner surface of the main part 103*b*.

The face panel 105 has a substantially rectangular main part and four side walls 105*a* connected to the periphery of the main part. Four stud pins 107 are respectively fixed to the inner surfaces of the four side walls 105*a*.

The four spring members 106 fixed to the frame 103 are respectively engaged with the four stud pins 107 fixed to the face panel 105, thereby fixing the shadow mask assembly 101 to the inside of the panel 105 so that the shadow mask 102 is apart from and opposite to the phosphor screen 104. The engagement of the members 106 and the pins 107 is realized by hooking the end of each pin 107 with the hole of each spring 106.

Although not shown, an inner shield is attached to the flange 103*a* of the frame 103 to suppress the effect of the geomagnetism.

The prior-art color CRT described above is termed the "mask-inner" type, because the skirt section 102*b* of the shadow mask 102 is inserted into the inside of the supporting frame 103 and fixed thereto.

Color CRTs have been often used as display devices for electronic terminal equipment such as personal computers. In recent years, in this case, larger display areas (i.e., larger screen size) tend to be desired to improve the visibility without reducing the amount of displayed information. Thus, the popular screen size has been increasing from 15 inches to 17, 19, or 21 inches.

However, as the screen size becomes larger, the size, weight, power consumption, and production cost of color CRTs will increase abruptly. Therefore, it is preferred to increase the effective display area as much as possible without enlarging the glass envelope. In other words, it is desired to use the display area as efficiently as possible.

From this point of view, as shown in FIG. 2, it is found that the above-described prior-art CRT has a comparatively large space S between the supporting frame 103 and the opposing sidewalls 105*a* of the face panel 105. This space S is generated due to the thickness or height of the spring members 106. Therefore, if the size of the face panel 105 is not changed, the maximum size of the rectangular opening of the frame 106, which is entirely covered with the shadow mask 102, is limited by the thickness or height of the spring members 106. As a result, even if the space S remains unused, a larger shadow mask is unable to be applied to the face panel 105. This means that the effective display area of the shadow mask 102 cannot be enlarged. In other words, the trajectory of electron beams emitted from the electron gun assembly provided in the neck of the vacuum envelope is unable to be bent in a wider range with respect to the central longitudinal axis of the envelope.

The space S may be narrowed by decreasing the thickness of the frame 103 and/or the thickness or height of the spring members 106. However, this causes a disadvantage that the mechanical strength of the frame 103 and/or the members 106 is lowered, and at the same time, this is incapable of generating a satisfactory result.

SUMMARY OF THE INVENTION

Accordingly, an object of the present invention to provide a color CRT that expands the effective display area without increasing the size of a face panel.

Another object of the present invention to provide a color CRT that makes it possible to use a larger-sized shadow mask without increasing the size of a face panel.

Still another object of the present invention to provide a color CRT that increases the maximum angle of the electron-beam trajectory with respect to the central longitudinal axis of a vacuum envelope.

The above objects together with others not specifically mentioned will become clear to those skilled in the art from the following description.

A color CRT according to the present invention has a feature that a frame for supporting a shadow mask has a front end section bent outwardly with respect to the remainder, thereby decreasing the gap or space between the frame and opposing sidewalls of a face panel.

In other words, the color CRT according to the present invention is comprised of a vacuum envelope having a face panel, a funnel connected to the panel, and a neck connected to the funnel. The envelope has a central longitudinal axis approximatley pernendicular to the panel. The panel has side walls formed at a periphery of its main part to extend approximately in parallel to the central longitudinal axis. Engagig pins are fixed to inner surfaces of the side walls.

A phosphor screen is formed on an inner surface of the main part of the panel.

A shadow mask assembly includes a frame with an opening and a shadow mask fixed to the frame to close the opening. The frame has a front section, a rear section, and a middle section located between the front and rear sections. The front section and the rear section extend approximately in parallel to the central longitudinal axis of the envelope. The front section is shifted outwardly with respect to the rear section. A periphery of the mask is fixed to the front section. Elastic engaging members are fixed to an outer surface of the rear section, The assembly is fixed to the panel by engaging respectively the engaging members of the frame with the engaging pins of the panel, thereby locating the mask apart from and opposed to the phosphor screen in the envelope.

With the color CRT according to the present invention, the frame in the shadow mask assembly has the front section extending approximately in parallel to the central longitudinal axis of the envelope, the rear section extending approximately in parallel to the central longitudinal axis of the envelope, and the middle section intervening between the front and rear sections. The front section is shifted outwardly with respect to the rear section. The periphery of the mask is fixed to the front section. Thus, the assembly is fixed to the panel by engaging respectively the engaging members of the frame with the engaging pins of the panel, thereby locating the mask apart from and opposed to the phosphor screen in the envelope.

Therefore, the shadow mask can be made larger in size without increasing the size of the face panel. In other words, the color CRT according to the present invention makes it possible to use a larger-sized shadow mask without increasing the size of the face panel. This means that the effective display area is expanded and the maximum angle of the electron-beam trajectory with respect to the central longitudinal axis of the envelope is increased, even if the face panel is not enlarged.

In a preferred embodiment of the CRT according to the invention, the middle and rear sections of the frame of the shadow mask assembly are connected to each other to form a step-shaped or abrupt cross section.

In another preferred embodiment of the CRT according to the invention, the middle and rear sections of the frame of the shadow mask assembly are connected to each other to form an oblique or linearly-graded cross section.

The shadow mask may be fixed to an inner surface of the front section of the frame. In this case, the assembly is of the "mask-inner" type. The shadow mask may be fixed to an outer surface of the front section of the frame. In this case, the assembly is of the "frame-inner" type.

BRIEF DESCRIPTION OF THE DRAWINGS

In order that the present invention may be readily carried into effect, it will now be described with reference to the accompanying drawings.

DETAILED DESCRIPTION OF THE PREFERRED EMBODIMENTS

Figure 1:
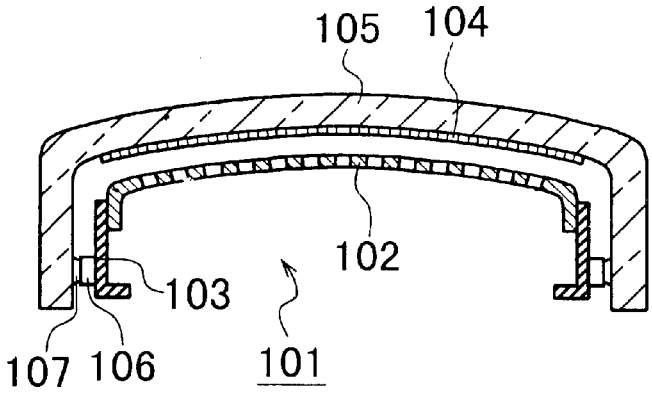
FIG. 1 PRIOR ART
FIG. 1 is a schematic cross-sectional view of a face panel and a shadow mask assembly of a prior-art color CRT.

Preferred embodiments of the present invention will be described in detail below while referring to the drawings attached.

First Embodiment

Figure 3:
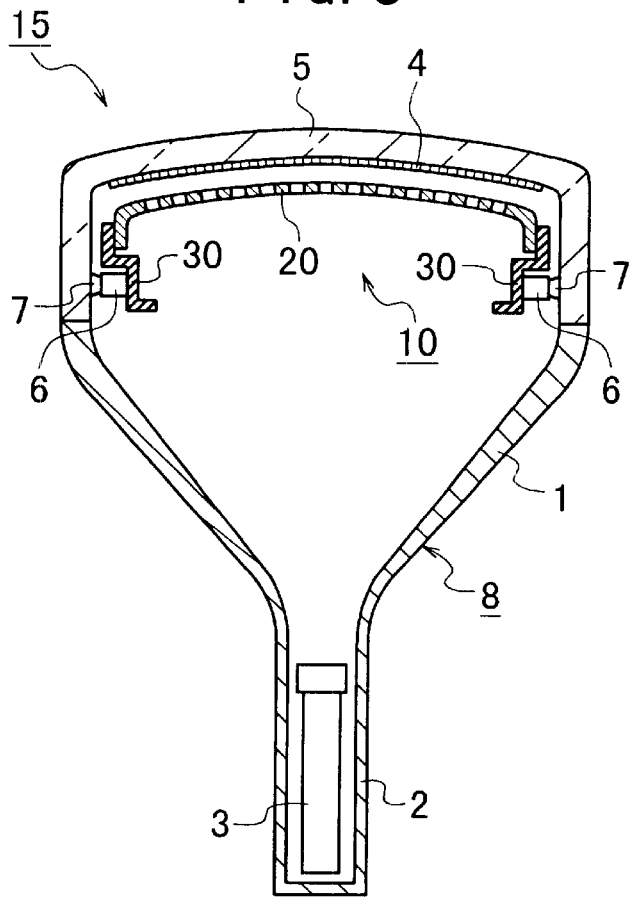
FIG. 3 is a schematic cross-sectional view of a color CRT according to a first embodiment of the invention.
Figure 4:
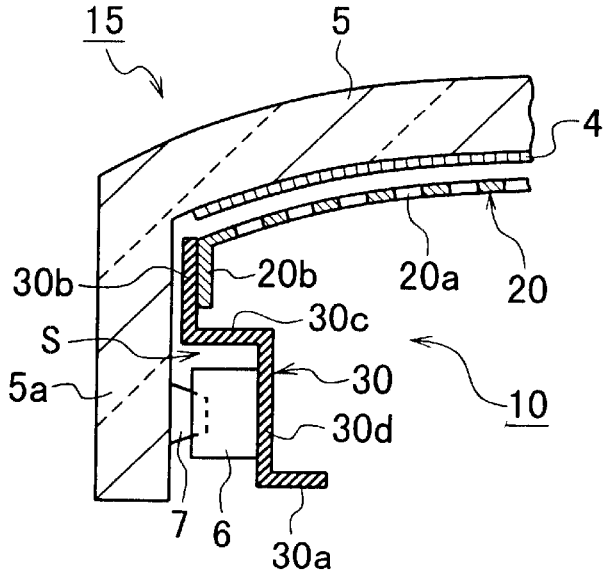
FIG. 4 is a schematic, enlarged, partial cross-sectional view of the face panel and the shadow mask assembly of the color CRT according to the first embodiment of FIG. 3.

A color CRT according to a first embodiment is shown in FIGS. 3 and 4.

As shown in FIG. 3, the color CRT 15 according to the first embodiment is comprised of a substantially rectangular face panel 5 on which an image is displayed. The panel 5 is connected to a roughly cone-shaped funnel 1 having a tubular neck 2, thereby forming a vacuum envelope. This envelope is made of glass.

A substantially rectangular phosphor screen 4 is formed on the inner surface of the face panel 5 in the envelope. A lot of stripes of phosphor materials (not shown) for red (R), green (g) and blue (B) colors are horizontally and vertically arranged in the entire screen 4. Each of the stripes is usually of a vertically elongated shape, i.e., of a vertically extending strip.

A shadow mask assembly 10 is fixed near the panel 5 in the envelope. The assembly 10 has a substantially rectangular shadow mask 20 and a substantially rectangular frame 30 for supporting the mask 20.

The mask 20 is fixed to the front end of the frame 30 so as to close the substantially rectangular opening of the frame 30. As shown in FIG. 3, the mask 20 is located apart from and opposed to the phosphor screen 4 in the envelope by using the frame 30. The mask 20 has a lot of small apertures 20*a* allowing selectively three electron beams for R, G, and B colors to arrive at the phosphor screen 4 through the mask 20.

In the neck 2 of the funnel 1, an electron gun assembly 3 is located for producing and emitting the electron beams for R, G, and B colors in the envelope. A deflection yoke (not shown) is provided outside the envelope around the funnel 1. The electron beams for R, G and B colors emitted from the gun assembly 3 are deflected by the horizontal and vertical deflecting magnetic-fields generated by the deflection yoke, and horizontally scanned over the entire phosphor screen 3. The electron beams passing through the apertures 20*a* of the shadow mask 20 strike the corresponding stripes of the phosphor materials of the screen 4 and excite them, thereby displaying a color image on the face panel 5.

Next, the configuration of the shadow mask assembly 10 is explained in more detail with reference to FIG. 4.

The frame 30 in the assembly 10 has a rectangular main part and a rectangular flange 30*a* formed at the rear end of the main part. The main part of the frame 30 is formed by substantially rectangular front, middle, and rear sections 30*b*, 30*c*, and 30*d*. The front and rear sections 30*b* and 30*d* are substantially in parallel to the central longitudinal axis of the envelope. The middle section 30*c* and the flange 30*a* are substantially perpendicular to the central longitudinal axis of the envelope. The front and middle sections 30*b* and 30*c* are directly connected to each other to form a step-shaped or abrupt cross section. Similarly, the middle and rear sections 30*c* and 30*d* are directly connected to each other to form a step-shaped or abrupt cross section. The flange 30*a* extends inwardly at an approximately right angle with respect to the rear section 30*d*.

Four spring or elastic members 6 are respectively fixed by welding onto the outer surfaces of the rear section 30*d* of the frame 30 at its four sides. Each of the members 6 is formed by an elongated metal piece bent to have a step-shaped cross-section.

The shadow mask 20 in the shadow mask assembly 10 includes a skirt section 20*b* extending along the central longitudinal axis of the envelope. The skirt section 20*b* is fixed to the front section 30*b* of the frame 30 by welding. Thus, the mask 20 is fixed to the frame 30 so as to fit into its rectangular opening.

The face panel 5 has a substantially rectangular main part on which the phosphor screen 4 is formed and four side walls 5*a* connected to the periphery of the main part. The side walls 5*a* extend substantially in parallel to the central longitudinal axis of the envelope. Four stud pins 7 are respectively fixed to the inner surfaces of the four sidewalls 5*a*.

Because the frame 30 has the middle section 30*c*, the front section 30*b* is shifted outwardly with respect to the rear section 30*d*, approaching the side walls 5*a* of the face panel 5.

As shown in FIG. 4, each of the four elastic or spring members 6 of the frame 30 is engaged with a corresponding one of the four stud pins 7 of the panel 5, thereby fixing the shadow mask assembly 10 to the inside of the panel 5 so that the shadow mask 20 is apart from and opposite to the phosphor screen 4. The engagement of the members 6 and the pins 7 is realized by hooking or engaging the end of each pin 7 with the hole of each member 6.

Although not shown, an inner shield is attached to the flange 30*a* of the frame 30 to suppress the effect of the geomagnetism to the electron beams.

The color CRT 15 according to the first embodiment of FIGS. 3 and 4 is termed the "mask-inner" type. This is because the skirt section 20*b* of the shadow mask 20 is inserted into the inside of the front section 30*b* of the frame 30 and fixed thereto, in other words, the outer surface of the skirt section 20*b* is fixed onto the inner surface of the front section 30*b*.

With the color CRT 15 according to the first embodiment of the present invention, as described above, the shadow mask assembly 10 includes the approximately rectangular shadow mask 20 and the approximately rectangular frame 30 for supporting the mask 20. The frame 30 has the approximately rectangular front and rear sections 30*b* and 30*d* extending in approximately parallel to the central longitudinal axis of the envelope, and the approximately rectangular middle section 30*c* interconnecting the front and rear sections 30*b* and 30*d*. Moreover, the front section 30*b* is shifted outwardly with respect to the rear section 30*d*, approaching the side walls 5*a* of the face panel 5.

Figure 2:
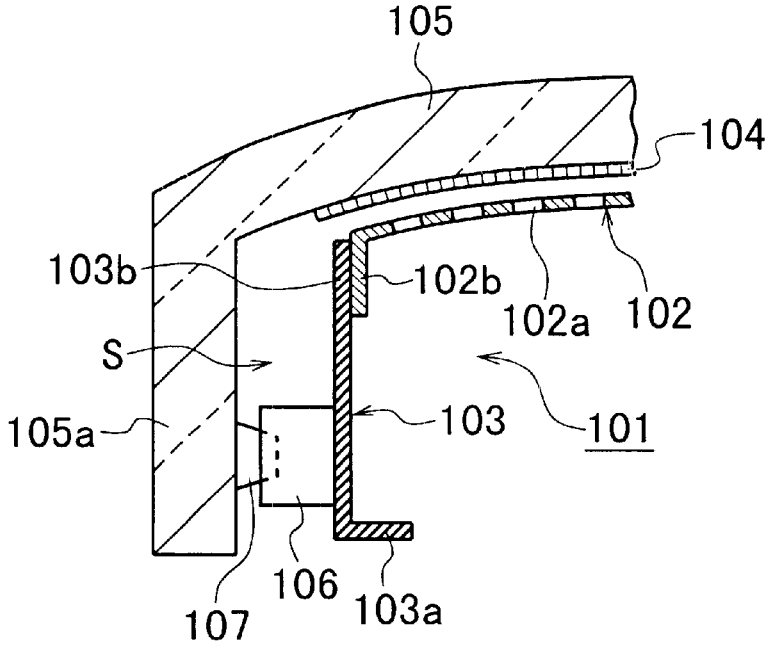
FIG. 2 PRIOR ART
FIG. 2 is a schematic, enlarged, partial cross-sectional view of the face panel and the shadow mask assembly of the prior-art color CRT shown in FIG. 1.

Therefore, the space existing between the panel 5 and the frame 30 is effectively used. As a result, the shadow mask 20, which is fixed to the front section 30*b* at its periphery, can be made larger in size compared with the previously-explained prior-art color CRT of FIGS. 1 and 2. In other words, the CRT 15 according to the first embodiment makes it possible to use a larger-sized shadow mask without increasing the size of the face panel. This means that the effective display area of the CRT 15 is expanded and the maximum angle of the electron-beam trajectory with respect to the central longitudinal axis of the envelope is increased, even if the face panel 5 is not enlarged.

Moreover, since no change is required for the vacuum envelope, there is an advantage that the design of the elastic members 6 needs not to be changed. If some change is applied to the size and/or shape of the envelope, the design of the members 6 needs to be changed according to new conditions such as the temperature characteristic.

Second Embodiment

Figure 5:
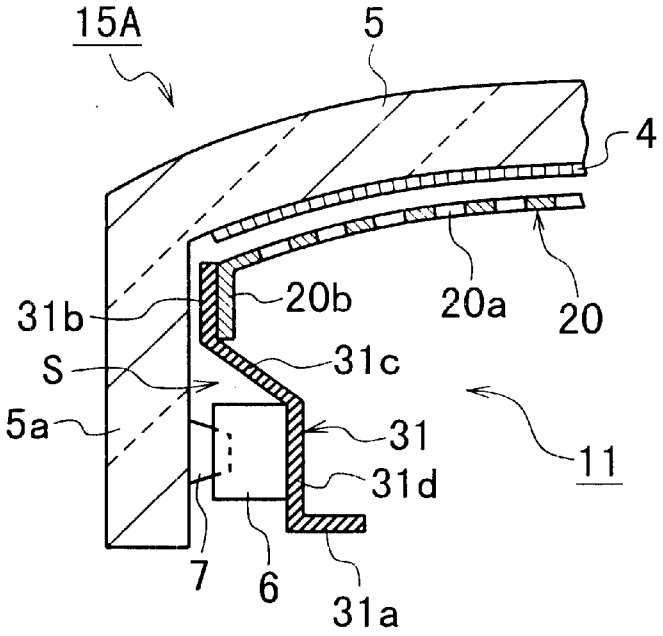
FIG. 5 is a schematic, enlarged, partial cross-sectional view of a face panel and a shadow mask assembly of a color CRT according to a second embodiment of the invention.

FIG. 5 shows a color CRT 15A according to a second embodiment, which has the same configuration as that of the first embodiment except that a frame 31 is provided instead of the frame 30. Therefore, the description relating to the same configuration is omitted here by attaching the same reference numerals as those used in the first embodiment of FIGS. 3 and 4 to the same or equivalent elements in FIG. 5 for the sake of simplification of description.

In the CRT 15A according to the second embodiment, the frame 31 has a rectangular main part and a rectangular flange 31*a* formed at the rear end of the main part. The main part of the frame 31 is formed by substantially rectangular front, middle, and rear sections 31*b*, 31*c*, and 31*d*. Similar to the first embodiment, the front and rear sections 31*b* and 31*d* are substantially in parallel to the central longitudinal axis of the envelope, and the flange 31*a* is substantially perpendicular to the same axis. The flange 31*a* is connected to the rear end of the rear section 31*d* and extends inwardly at an approximately right angle with respect to the rear section 31*d*.

However, unlike the first embodiment, the middle section 31*c* is oblique to the central longitudinal axis of the envelope. The front and middle sections 31*b* and 31*c* are directly connected to each other to form an oblique or linearly-graded cross section. Similarly, the middle and rear sections 31*c* and 31*d* are directly connected to each other to form an oblique or linearly-graded cross section.

The skirt section 20*b* of the shadow mask 20 is fixed to the inner surface of the front section 31*b*. The spring members 6 are fixed to the outer surface of the rear section 31*d* at its four sides. Therefore, the CRT 15A is of the "mask-inner" type.

Needless to say, the CRT 15A according to the second embodiment has the same advantages as those in the first embodiment of FIGS. 3 and 4.

Third Embodiment

Figure 6:
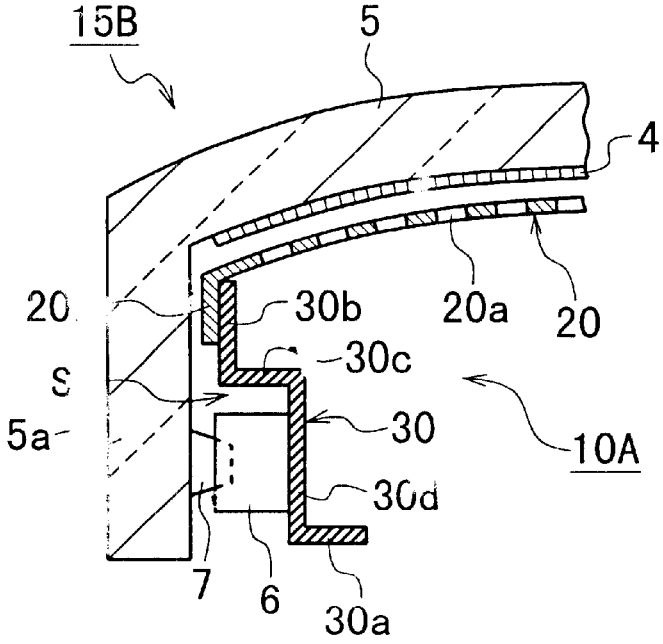
FIG. 6 is a schematic, enlarged, partial cross-sectional view of a face panel and a shadow mask assembly of a color CRT according to a third embodiment of the invention.

FIG. 6 shows a color CRT 15B according to a third embodiment, which has the same configuration as that of the first embodiment except that a shadow mask assembly 10A is provided instead of the shadow mask assembly 10. Therefore, the description relating to the same configuration is omitted here by attaching the same reference numerals as those used in the first embodiment of FIGS. 3 and 4 to the same or equivalent elements in FIG. 6 for the sake of simplification of description.

In the shadow mask assembly 10A of the CRT 15B according to the third embodiment, opposite to the first embodiment, the front section 30*b* of the frame 30 is inserted into the skirt section 20*b* of the shadow mask 20. The inner surface of the skirt section 20*b* is fixed to the outer surface of the front section 30*b*. Therefore, the CRT 15B is of the "frame-inner" type.

It is obvious that the CRT 15B according to the third embodiment has the same advantages as those in the first embodiment.

Similar to the third embodiment, the front section 31*b* of the frame 31 may be inserted into the skirt section 20*b* of the shadow mask 20 in the CRT according to the second embodiment of FIG. 5. In this case, the inner surface of the skirt section 20*b* is fixed to the outer surface of the front section 31*b* and therefore, the CRT is of the "frame-inner" type.

In the above-described CRTs according to the first to third embodiments, the main part of the frame is formed by the front, middle, and rear sections directly connected to each other. However, the present invention is not limited to this structure. It is sufficient for the invention that the front section is shifted outwardly with respect to the rear section to approach the side walls of the face panel. Therefore, the middle section may have any other shape or structure and at least one section may be added to the middle section.

While the preferred forms of the present invention have been described, it is to be understood that modifications will be apparent to those skilled in the art without departing from the spirit of the invention. The scope of the invention, therefore, is to be determined solely by the following claims.

What is claimed is:

1. A color CRT comprising:

a vacuum envelope having a face panel, a funnel connected to the panel, and a neck connected to the funnel;

said envelope having a central longitudinal axis approximately perpendicular to said panel;

said panel having side walls formed at a periphery of its main part to extend approximately parallel to said central longitudinal axis, engaging pins being fixed to inner surfaces of said side walls;

a phosphor screen formed on an inner surface of said main part of said panel;

a shadow mask assembly including a frame with an opening and a shadow mask fixed to a side surface of said frame to close said opening;

said frame having a front section, a rear section, a middle section located between said front section and said rear section and a flange formed at the rear section of said frame;

said front section and said rear section extending approximately parallel to said central longitudinal axis of said envelope;

said front section being shifted outwardly with respect to said rear section;

a periphery of said mask being fixed to a side surface of said front section;

elastic engaging members being fixed to an outer surface of said rear section; and said assembly being fixed to said panel by engaging respectively said engaging members of said frame with said engaging pins of said panel, thereby locating said mask apart from and opposed to said phosphor screen in said envelope.

2. The CRT according to claim 1, wherein said middle section and said rear section of said frame of said shadow mask assembly are connected to each other to form a step-shaped cross section.

3. The CRT according to claim 1, wherein said middle section and said rear section of said frame of said shadow mask assembly are connected to each other to form a linearly-graded cross section.

4. The CRT according to claim 1, wherein said shadow mask is fixed to an inner surface of said front section of said frame.

5. The CRT according to claim 1, wherein said shadow mask is fixed to an outer surface of said front section of said frame.

6. The color CRT according to claim 1, wherein said front section, said middle section, said rear section and said flange are substantially rectangular shaped.

7. The color CRT according to claim 1, wherein said middle section and said flange are substantially perpendicular to said central longitudinal axis of the envelope.

8. The color CRT according to claim 1, wherein said flange extends inwardly at an approximately right angle with respect to said rear section.

9. The color CRT according to claim 1, wherein said front section is bent outward with respect to said rear section thereby decreasing a gap between said frame and opposing sidewalls of said face panel.

10. The color CRT according to claim 1, wherein said middle and rear sections of said frame of said shadow mask assembly are connected to each other to form an oblique cross section.

11. The color CRT according to claim 1, wherein said opening of said frame is substantially rectangular shaped.

12. The color CRT according to claim 1, wherein said shadow mask and said frame are approximately rectangular shaped.

13.The color CRT according to claim 1, wherein said middle section is oblique to said central longitudinal axis of said envelope.

14. The color CRT according to claim 1, wherein said front section and said middle section are directly connected to form an oblique cross section.

15. The color CRT according to claim 1, wherein said middle section includes at least one section.

16. The color CRT according to claim 1, wherein the widths of said elastic engaging members are substantially no greater than that of said flange, thereby to reduce a gap between said sidewalls and said shadow mask.

17. The color CRT according to claim 16, wherein said engaging pins are connected to stud pins, thereby to reduce a gap between said sidewalls and said shadow mask.

18. The color CRT according to claim 16, wherein said flange is zig-zag shaped, thereby to reduce a gap between said sidewalls and said shadow mask.

19. The color CRT according to claim 1, wherein said flange includes an oblique cross-sectional surface, thereby to reduce a gap between said sidewalls and said shadow mask.

20. The color CRT according to claim 1, wherein said front section is shifted outwardly with respect to said rear section to extend toward the frame, thereby to reduce a gap between said sidewalls and said shadow mask.

* * * * *